US005912686A

United States Patent [19]

Palmer et al.

[11] Patent Number: 5,912,686

[45] Date of Patent: Jun. 15, 1999

[54] INK JET PRINTHEAD AND AN ARMATURE THEREFOR

[75] Inventors: Danny Charles Palmer, Cambridgeshire; Jerzy Marcin Zaba, Cambridge, both of United Kingdom

[73] Assignee: Domino Printing Sciences Plc, United Kingdom

[21] Appl. No.: 08/793,594

[22] PCT Filed: Oct. 23, 1995

[86] PCT No.: PCT/GB95/02515

§ 371 Date: Mar. 6, 1997

§ 102(e) Date: Mar. 6, 1997

[87] PCT Pub. No.: WO96/12622

PCT Pub. Date: May 2, 1996

[30] Foreign Application Priority Data

Oct. 24, 1994 [GB] United Kingdom ..... 9421393

[51] Int. Cl.[6] ..... B41J 2/02

[52] U.S. Cl. ..... 347/75

[58] Field of Search ..... 347/75, 74, 73, 347/72

[56] References Cited

U.S. PATENT DOCUMENTS 4,554,558 11/1985 Beaudet et al. ..... 347/75

*Primary Examiner*—N. Le
*Assistant Examiner*—Thien Tran
*Attorney, Agent, or Firm*—Laff, Whitesel, Conte & Saret, Ltd.

[57] ABSTRACT

An armature (1) for an actuator drive for a multi-jet continuous ink jet printhead has, at one side, a row of transducer mountings (10). The armature (1) has a plurality of elongate slots (5) therethrough in a row parallel to the one side, each slot (5) extending away from the one side and being aligned intermediate to the transducer mountings (10), whereby lands (6) between the slots (5) are aligned with the transducer mountings (10).

9 Claims, 3 Drawing Sheets

INK JET PRINTHEAD AND AN ARMATURE THEREFOR

BACKGROUND OF THE INVENTION

1. Field of the Invention

The present invention relates to ink jet printers and, more particularly, to an actuator drive for a multi-jet continuous ink jet printer.

In a multi-jet continuous ink jet printer, in order to create streams of droplets issuing through multiple nozzles or orifices, it is known to pressure modulate the fluid by means of plural piezoelectrically actuated drive rods or else by a single piezoelectrically actuated armature. A problem associated with plural drive rods is the need to ensure syncronicity between the independent drive rods so that they are all vibrating in phase. A problem with a single armature causing jets to issue through a row of orifices is that of preventing transverse flexure and non-uniformity of pressure changes across the row of orifices.

2. Description of Related Arts

It is also known, in a multi-jet continuous inkjet printer, to create streams of droplets by means of the velocity modulator or resonator as shown in U.S. Pat. No. 4,999,647. In U.S. Pat. No. 4,999,647 a resonator is shown with elongate slots disposed between transducers mounted within the resonator and an ink passage passes through the resonator and communicates with orifices in an orifice plate bonded to one side of the resonator.

BRIEF SUMMARY OF THE INVENTION

According to the present invention there is provided a multi-jet continuous ink jet printhead having an ink chamber, the chamber having a plurality of orifices for the emission of fluid droplets therefrom, and an actuator drive armature with a plurality of elongate slots therethrough disposed in a row, characterised in that the armature is disposed within the ink chamber, and has a row of transducer mountings at one side and a drive wall at the other side, the slots being disposed in the drive wall in a row parallel to the one side of the armature, and each slot extending away from the one side and being aligned intermediate the transducer mountings, whereby lands between the slots are aligned with the transducer mountings.

Preferably, the number of slots is one less than the number of orifices in the printhead, so that a land is aligned with each orifice.

In a preferred embodiment, the number of transducer mountings is equal to the number of orifices in the printhead, but in alternative constructions the number of transducer mountings may be less than the number of orifices. Thus, the armature may have a number of lands greater then the number of transducers employed.

Preferably, the armature plate is slit at positions between the transducer mountings parallel with the slots in the armature, in order to reduce crosstalk between adjacent transducers in use.

BRIEF DESCRIPTION OF SEVERAL VIEWS OF THE DRAWING(S)

One example of an actuator drive according to the present invention will now be described with reference to the accompanying drawings in which.

Figure 1:
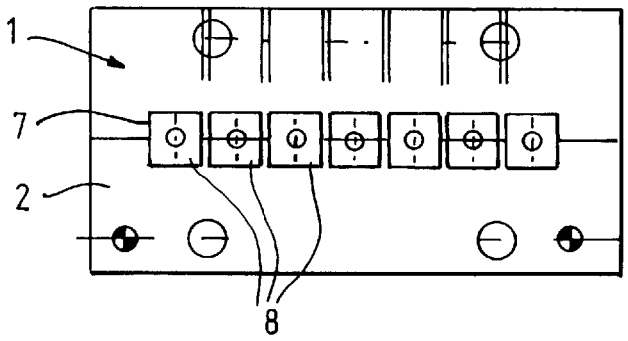
FIG. 1 is a plan view of an actuator drive armature.
Figure 5A:
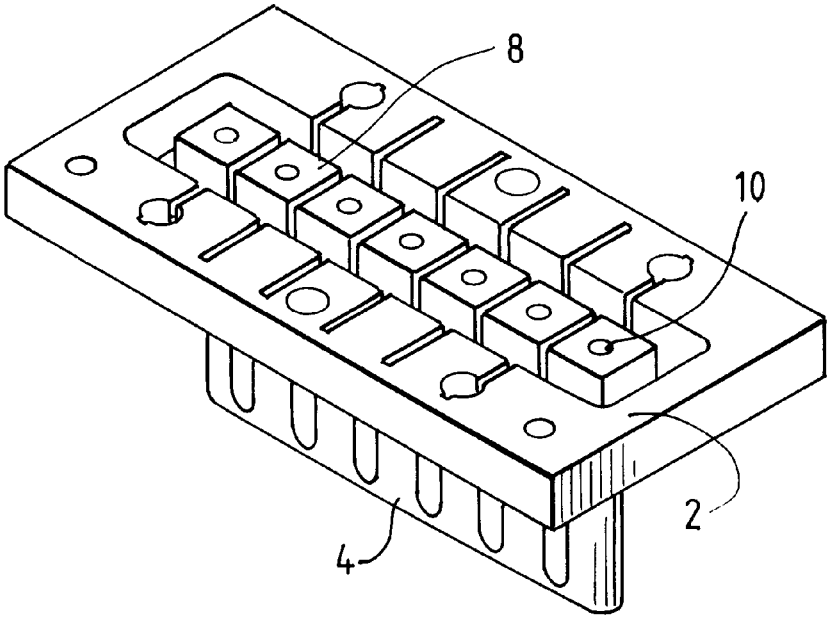
Figure 6:
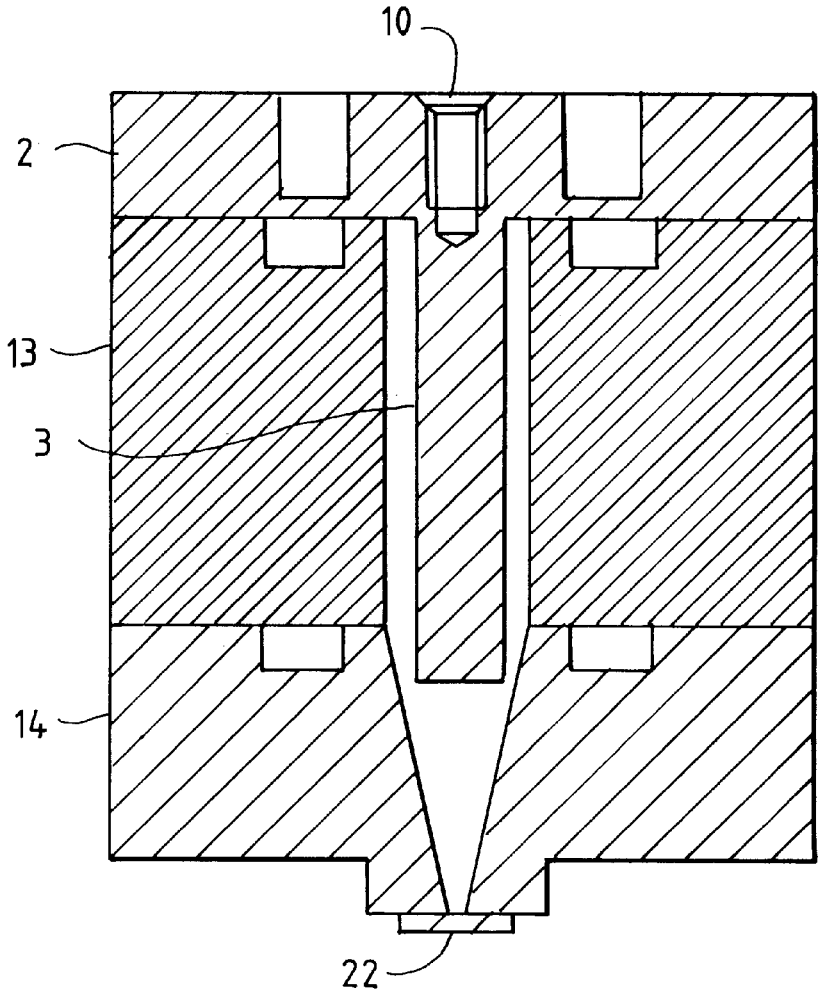

FIGS. 5A & B are views of the actuator drive armature of FIG. 1, together with a body; and FIG. 6 is a cross-sectional view of the actuator drive armature of FIG. 1 connected for use.

Figure 7:
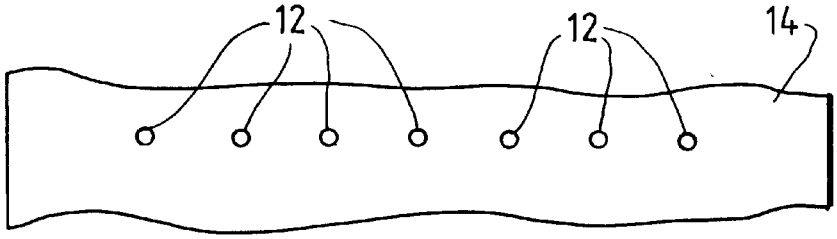

FIG. 7 is a bottom planview of the printhead.

DETAILED DESCRIPTION OF THE INVENTION

Figure 4:
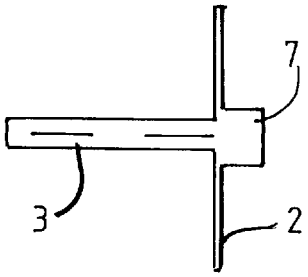
FIG. 4 is an end view.
Figure 5B:
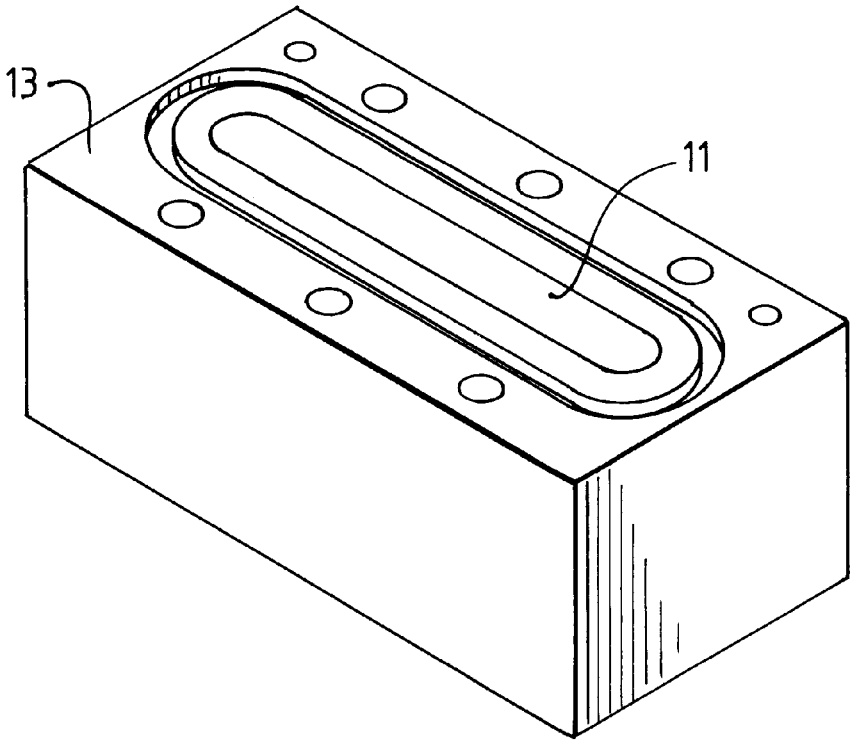

The actuator drive armature 1 comprises a stainless steel member having a mounting flange 2 by means of which the armature is secured within an ink chamber 11 defined by a body 13 and orifice plate 14 as in FIGS. 1, 5B and 6. Extending perpendicularly away from the flange 2 on one side is a drive wall 3 which has a lower surface 4 which, in use, is disposed above orifices 12 in orifice plate 14 from which ink is ejected from the ink chamber 11 as in FIGS. 6–7. The drive wall 3 has a plurality of elongate slots 5 formed through it at a pitch corresponding to the pitch of the orifices 12, thereby forming a series of lands 6, each of which is disposed, in use, above a respective orifice 12 as in FIG. 2. An upward extension 7 of the wall 3 is formed as a series of square-sectioned protrusions 8, separated from one another by slits 9 and having central bores 10 by means of which individual piezoelectric transducers can be mounted onto the armature in order to cause it to vibrate in use as in FIGS. 2–4.

Figure 2:
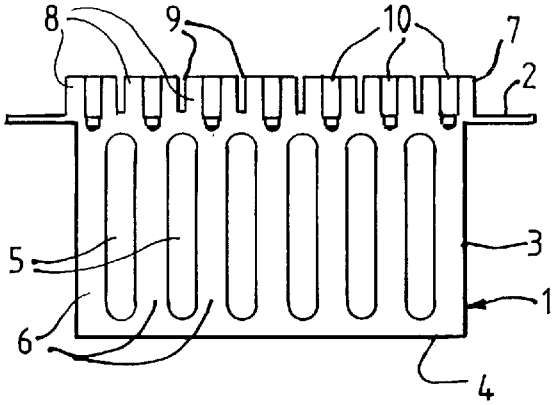
FIG. 2 is a side view.
Figure 3:
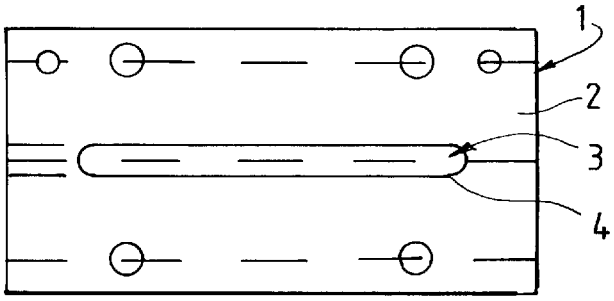
FIG. 3 is an underneath plan view.

The provision of the slots 5, defining the lands 6, prevents transverse flexure whilst providing for uniform energy transmission into the ink within the chamber and thus uniform generation of droplets from the row of orifices as in FIG. 2.

The slits 9 between the mounting protrusions 8 act to reduce cross-talk between individual piezoelectric transducers as in FIGS. 2B & 5A.

We claim:

1. A multi-jet continuous ink jet printhead having an ink chamber, the chamber having a plurality of orifices for emission of fluid droplets therefrom, and an actuator drive armature with a plurality of elongate slots therethrough disposed in a row, comprising, the armature is disposed within the ink chamber the armature has a row of transducer mountings (8) at one side and a drive wall at another side, the slots being disposed in the drive wall in a row parallel to the one side of the armature, and each slot extend away from the one side and being aligned intermediate the transducer mountings, whereby lands between the slots are aligned with the transducer mountings.

2. A printhead according to claim 1, wherein the armature has slits at positions between the transducer mountings, parallel with the slots (5) in the drive wall, in order to reduce crosstalk between adjacent transducers in use.

3. A printhead according to claim 1 or claim 2, wherein the plurality of slots in the armature drive wall (3) is one less than the plurality of orifices in the chamber, so that one of said lands is aligned with each orifice.

4. A printhead according to claim 3, wherein the number of transducer mountings is equal to the number of orifices in the ink chamber.

5. A printhead according to claim 3, wherein the number of transducer mountings is less than the number of orifices in the ink chamber.

6. A printhead according to claim 1 or 2, wherein the orifices are disposed in an orifice plate.

7. An actuator drive armature for an ink jet printhead wherein the printhead has an ink chamber with a plurality of orifices for emission of ink droplets from said chamber, said armature comprising:

a mounting flange to secure said armature to the ink chamber, a plurality of spaced transducer mountings extending from one side of said flange, a drive wall extending from an opposite side of said flange, said drive wall having a lower surface which is disposed above said orifices when said armature is mounted in the ink chamber, and said drive wall having a plurality of parallel spaced slots, said slots extending in a direction away from said flange toward said lower surface, and a plurality of lands between said slots.

8. The actuator drive armature of claim 7 wherein said transducer mountings include a plurality of spaced bores to provide for individual piezoelectric transducers being mounted onto the armature.

9. The actuator drive armature of claim 8 wherein the plurality of spaced bores are formed by a series of protrusions separated from each other by slits.

* * * * *